US011009018B2

(12) United States Patent
Wyss et al.

(10) Patent No.: US 11,009,018 B2
(45) Date of Patent: May 18, 2021

(54) MICROPUMP

(71) Applicant: SENSILE MEDICAL AG, Olten (CH)

(72) Inventors: Thomas Wyss, Zuchwil (CH); Alexandre Perrier, Liestal (CH); Christian Huber, Bern (CH); Matthias Muller, Olten (CH)

(73) Assignee: SENSILE MEDICAL AG, Olten (CH)

( * ) Notice: Subject to any disclaimer, the term of this patent is extended or adjusted under 35 U.S.C. 154(b) by 0 days.

(21) Appl. No.: 16/957,845

(22) PCT Filed: Dec. 17, 2018

(86) PCT No.: PCT/EP2018/085336
§ 371 (c)(1),
(2) Date: Jun. 25, 2020

(87) PCT Pub. No.: WO2019/129532
PCT Pub. Date: Jul. 4, 2019

(65) Prior Publication Data

US 2020/0378375 A1 Dec. 3, 2020

(30) Foreign Application Priority Data

Dec. 28, 2017 (EP) ..... 17210840

(51) Int. Cl.
*F04B 19/00* (2006.01)
*F04B 9/04* (2006.01)
(Continued)

(52) U.S. Cl.
CPC ..... *F04B 19/006* (2013.01); *F04B 7/06* (2013.01); *F04B 9/042* (2013.01); *F04B 13/00* (2013.01); *F04B 19/22* (2013.01); *F04B 43/043* (2013.01)

(58) Field of Classification Search
CPC ..... F04B 13/00; F04B 19/006; F04B 53/14; F04B 7/04; F04B 7/06; F04B 19/025;
(Continued)

(56) References Cited

U.S. PATENT DOCUMENTS 5,472,320 A * 12/1995 Weisbrodt ..... F04B 7/06 417/326
7,726,955 B2 6/2010 Ryser et al.
(Continued)

FOREIGN PATENT DOCUMENTS

DE 10 2011 083579 11/2012
EP 0556622 A1 * 8/1993 ..... F04B 19/006
(Continued)

OTHER PUBLICATIONS

Written Opinion in International Application No. PCT/EP2018/085336, dated Mar. 4, 2019, pp. 1-7.
(Continued)

*Primary Examiner* — Dominick L Plakkoottam
(74) *Attorney, Agent, or Firm* — Saliwanchik, Lloyd & Eisenschenk

(57) ABSTRACT

A pump (2) comprising a stator (4) and a rotor (6) axially and rotatably movable relative to the stator, the stator comprising a rotor shaft receiving cavity (18), an inlet (14) and an outlet (16) fluidly connected to the rotor shaft receiving cavity (18), the rotor comprising a shaft (24) received in the rotor shaft receiving cavity (18). The rotor shaft (24) comprises a cavity (39) receiving a piston portion (12) of the stator therein to form a piston chamber (42), a seal (44) mounted between the piston portion (12) and inner sidewall of the cavity (39) to sealingly close an end of the piston chamber (42). The rotor further comprises a port (38) fluidly connecting the piston chamber (42) to an outer surface (60) of the rotor shaft (24), the port (38) arranged to overlap at least
(Continued)

partially the inlet (14) over a rotational angle α of the rotor corresponding to a pump intake phase, and arranged to overlap at least partially the outlet (14) over a rotational angle β of the rotor corresponding to a pump expel phase.

13 Claims, 5 Drawing Sheets

(51) Int. Cl.

| | |
|---|---|
| ***F04B 13/00*** | (2006.01) |
| ***F04B 43/04*** | (2006.01) |
| ***F04B 7/06*** | (2006.01) |
| ***F04B 19/22*** | (2006.01) |

(58) Field of Classification Search
CPC ..... F04B 19/22; A61M 5/14216; A61M 2205/103; A61M 5/31513
See application file for complete search history.

(56) References Cited

U.S. PATENT DOCUMENTS

| | | | | |
|---|---|---|---|---|
| 7,798,783 | B2 * | 9/2010 | Burns | F04B 7/06 417/53 |
| 8,282,366 | B2 * | 10/2012 | Hilber | F04B 51/00 417/420 |
| 8,910,602 | B2 * | 12/2014 | Bohner | F15B 21/041 123/90.17 |
| 9,222,470 | B2 | 12/2015 | Genoud et al. | |
| 9,261,085 | B2 * | 2/2016 | Middleton | F04B 53/166 |
| 9,416,775 | B2 | 8/2016 | Focht et al. | |
| 9,828,978 | B2 * | 11/2017 | Middleton | F04B 23/02 |
| 9,879,668 | B2 * | 1/2018 | Yavorsky | A61M 5/16831 |
| 10,213,796 | B2 | 2/2019 | Frey | |
| 2007/0071596 | A1 | 3/2007 | Ryser et al. | |
| 2009/0123309 | A1 | 5/2009 | Hilber et al. | |
| 2010/0305508 | A1 | 12/2010 | Franks | |
| 2013/0017099 | A1 | 1/2013 | Genoud et al. | |
| 2014/0231549 | A1 | 8/2014 | Thiemer et al. | |
| 2016/0160854 | A1 | 6/2016 | Dehan et al. | |
| 2016/0369790 | A1 | 12/2016 | Yavorsky et al. | |
| 2018/0036750 | A1 | 2/2018 | Frey | |
| 2018/0185570 | A1 * | 7/2018 | Niklaus | A61M 5/14216 |
| 2020/0182235 | A1 * | 6/2020 | Yanagibayashi | F04B 49/06 |
| 2020/0309104 | A1 | 10/2020 | Burli et al. | |
| 2020/0378387 | A1 | 12/2020 | Girschweiler et al. | |
| 2021/0017969 | A1 | 1/2021 | Brandt et al. | |

FOREIGN PATENT DOCUMENTS

| | | |
|---|---|---|
| EP | 1 677 859 | 7/2006 |
| EP | 1 803 934 | 7/2007 |
| EP | 2 275 678 | 1/2011 |
| EP | 2 921 189 | 9/2015 |
| EP | 2 962 714 | 1/2016 |
| WO | WO 2006/037171 | 4/2006 |
| WO | WO 2006/056828 | 6/2006 |
| WO | WO 2011/114285 | 9/2011 |

OTHER PUBLICATIONS

Written Opinion in International Application No. PCT/EP2018/083247, dated Jan. 21, 2019, pp. 1-7.
Written Opinion in International Application No. PCT/EP2018/083390, dated Jan. 30, 2019, pp. 1-10.
Written Opinion in International Application No. PCT/EP2018/084247, dated Feb. 28, 2019, pp. 1-7.

* cited by examiner

MICROPUMP

CROSS-REFERENCE TO RELATED APPLICATION

This application is the U.S. national stage application of International Patent Application No. PCT/EP2018/085336, filed Dec. 17, 2018.

TECHNICAL FIELD

The present invention relates to a micropump. The micropump may be used for dispensing small quantities of liquid, in particular for use in medical applications, for instance in a drug delivery device. A micropump related to the invention may also be used in non-medical applications that require high precision delivery of small quantities of liquid.

DESCRIPTION OF RELATED ART

A micropump for delivering small quantities of liquid that may in particular be used in medical and non-medical applications is described in EP1803934 and in EP1677859. The micropump described in the aforementioned documents includes a rotor with first and second axial extensions of different diameters that engage with first and second seals of the stator to create first and second valves that open and close liquid communication across the respective seal as a function of the angular and axial displacement of the rotor. A pump chamber is formed between the first and second seals of the stator whereby the pumped volume of liquid per rotation cycle of the rotor is a function of both the difference in diameters between the first and second rotor axial extensions and the axial displacement of the rotor that is effected by a cam system as a function of the angular position of the rotor with respect to the stator.

The ability to pump small quantities of liquids by continuous rotation of a rotor is advantageous in many situations. In view of the small volume of liquid pumped per rotation cycle, the rotary drive output may rotate at speeds that are generally greater than the speed of a screw mechanism for advancing a piston of a piston pump. The rotary drive is simple to control and avoiding a piston mechanism allows the pump to be very compact. Also, the pump module may be made of low cost disposable parts, for instance of injected polymers.

In certain applications, in particular for pumping liquids containing molecules that are sensitive to friction, the friction between the rotor shaft and the valve seals of a pump as described in EP1803934 may however be undesirable. This could for instance be a problem with large molecules such as certain proteins that are sensitive to shear stress.

The aforementioned problem could be overcome by provision of other pump systems, in particular piston pumps or pumps comprising cartridges with a plunger that is advanced by a piston rod. Such pump systems are however not very economical and not very compact in view of the length of the piston mechanism. Reliability and safety of piston pump systems may also be an issue because they do not inherently block direct fluid communication between the liquid container and the outlet of the pump system.

SUMMARY OF THE INVENTION

In view of the foregoing, an object of the invention is to provide a micropump that is capable of pumping small quantities of liquid in a reliable and safe manner.

It is advantageous in certain applications to provide a micropump that does not apply shear stress on the liquid being pumped.

It is advantageous to provide a micropump that is very compact.

It is advantageous to provide a micropump that is economical to manufacture and that may be incorporated in a disposable non-reusable component, such as in a disposable part of a drug delivery device.

Objects of the invention are achieved by a micropump according to claim 1.

Disclosed herein is a micropump comprising a stator and a rotor axially and rotatably movable relative to the stator, the stator comprising a rotor shaft receiving cavity, an inlet and an outlet fluidly connected to the rotor shaft receiving cavity, the rotor comprising a shaft received in the rotor shaft receiving cavity. The rotor shaft comprises a rotor cavity receiving a piston portion of the stator therein to form a piston chamber, a seal mounted between the piston portion and inner sidewall of the rotor cavity to sealingly close an end of the piston chamber, the rotor further comprising a rotor shaft port fluidly connecting the piston chamber to an outer surface of the rotor shaft, the rotor shaft port arranged to overlap at least partially the inlet over a rotational angle ($\alpha$) of the rotor corresponding to a pump intake phase, and arranged to overlap at least partially the outlet over a rotational angle ($\beta$) of the rotor corresponding to a pump expel phase.

In an advantageous embodiment, the rotor shaft port comprises an entry portion having a convex or tapered shape with a large diameter at the rotor outer surface and a small diameter towards the rotor cavity.

In an advantageous embodiment, the inlet has an oblong shape that extends over an angular segment of at least at 30°.

In an advantageous embodiment, the outlet has an oblong shape that extends over an angular segment of at least at 30°.

In an advantageous embodiment, the inlet extends over an angle about the axis of rotation A along an inner surface of the rotor shaft receiving cavity between 30° and 120°.

In an advantageous embodiment, the outlet extends over an angle about the axis of rotation A along an inner surface of the rotor shaft receiving cavity between 30° and 120°.

In an advantageous embodiment, the piston portion extends from a base wall of the stator, an end of the rotor shaft positioned adjacent the base wall.

In an advantageous embodiment, the stator and rotor comprise a camming system defining an axial displacement of the rotor relative to the stator as a function of the angular displacement of the rotor relative to the stator.

In an advantageous embodiment, the pump comprises a rotary drive coupled in rotation to the rotor via a coupling, the coupling comprising a biasing mechanism applying a force (Fx) on the rotor towards the stator.

In an advantageous embodiment, the camming system comprises a cam track on one of the rotor and the stator, and a cam follower on one of the stator and the rotor, the cam track and cam follower being positioned on an outer diameter of a head of the rotor, the head being connected to an end of the rotor shaft.

In another embodiment, the pump may further comprise an elastic membrane positioned between the rotor and the stator and arranged to cover an entry portion of the port on the rotor shaft, the membrane being deformable into the entry portion due to a pressure on an inlet side being greater than a pressure in the piston chamber.

In an embodiment, the membrane may be fixed non-rotatably to the stator.

In an embodiment, the membrane may be fixed to the rotor and cover the entry portion of the port.

Further objects and advantageous features of the invention will be apparent from the claims, from the detailed description, and annexed drawings, in which:

DETAILED DESCRIPTION OF EXEMPLARY EMBODIMENTS

Figure 1:
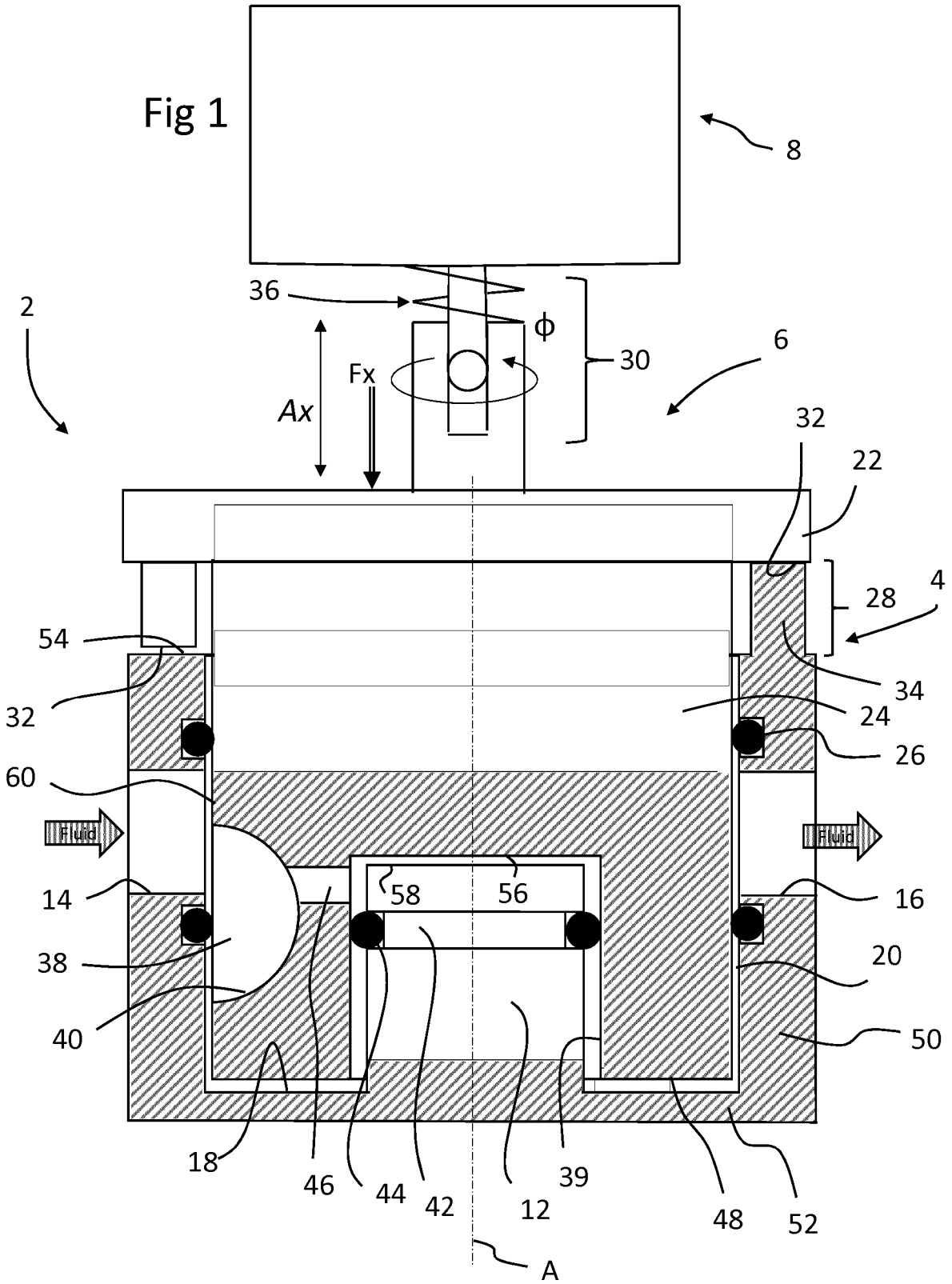
FIG. 1 is a schematic cross-sectional view of a pump module of a micropump according to a first embodiment of the invention.

Referring to the figures, a micropump 2 according to embodiments of the invention comprises a stator 4 and a rotor 6 coupled to a rotary drive 8 that rotates the rotor 6 around an axis A relative to the stator 4. The rotor 6 is also axially movable relative to the stator, the axial direction Ax being aligned with the axis of rotation A.

The rotary drive 8 is coupled to the rotor 6 via a coupling 30 that allows axial displacement of the rotor relative to the motor yet couples the output of the rotary drive in rotation to the rotor. The coupling 30 comprises a biasing mechanism 36, for instance in the form of a spring, such as a coil spring that applies an axial force Fx towards the stator 4.

The rotor and stator comprise a camming system 28 that defines an axial displacement of the rotor as a function of angular displacement of the rotor. The camming system 28 may comprise a cam track 32 biased against a complementary cam follower 34, the biasing mechanism 36 ensuring that the cam follower presses against the cam track. The cam track 32 has a profile P that defines the axial position of the rotor relative to the stator as a function of the angular position of the rotor relative to the stator.

Figure 6:
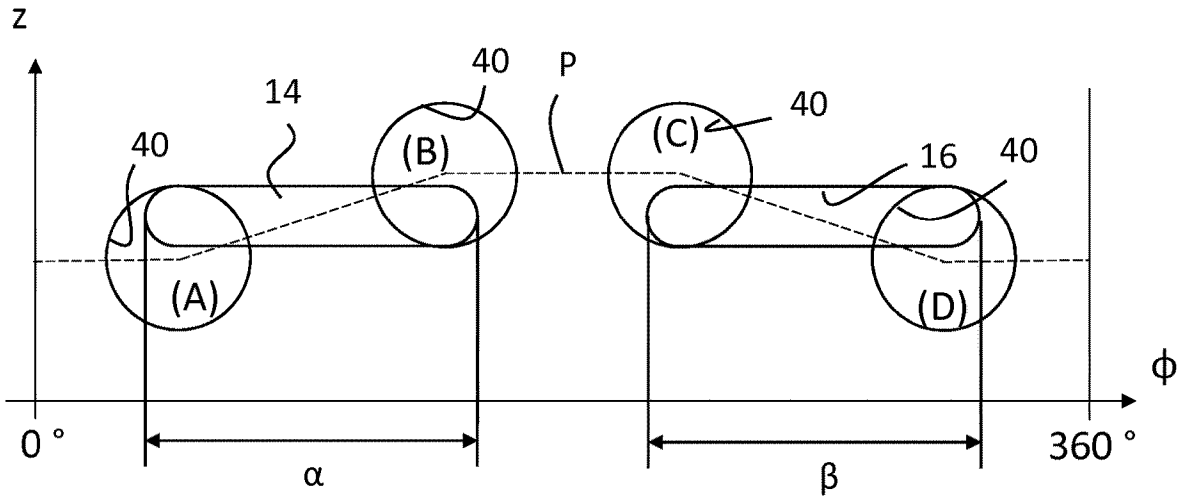
FIG. 6 is view illustrating a developed displacement profile of a rotor valve port relative to a stator inlet and outlet over a 360° rotation cycle, according to the second embodiment.
Figure 5:
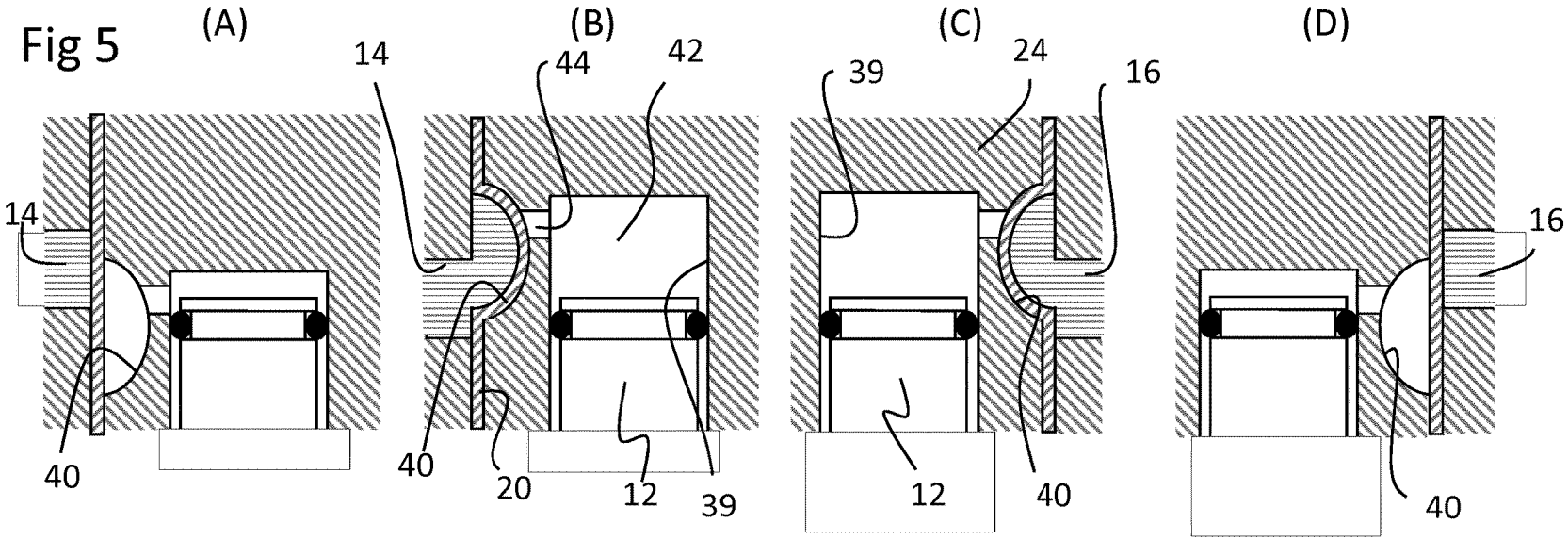
FIGS. 5*a*-5*d* are schematic cross-sectional views illustrating different four rotor positions in a pump cycle of the pump according to the second embodiment, from intake to expulsion of liquid.

An example of a cam track profile P developed over a 360° rotation cycle is illustrated in FIGS. 3 and 6.

In the embodiments illustrated, the cam track 32 is formed on a head 22 of the rotor 6 whereas the complementary cam follower 34 is provided on a rim of the stator 4. The skilled person will however appreciate that the cam follower may be provided on the rotor and the cam track on the stator.

In the illustrated embodiments, the biasing mechanism 36 and camming system 28 form together an axial displacement system defining the axial displacement of the rotor relative to the stator as a function of the rotor's angular position, however other axial displacement systems may be implemented without departing from the scope of the invention. For instance, axial displacement may be effected by an electromagnetic actuator coupled to the rotary drive, or may be provided by means of a drive that outputs both a rotational and an axial movement.

The stator 4 comprises a cavity 18 and the rotor 6 comprises a shaft 24 rotatably and slidably inserted in the cavity 18. The rotor shaft receiving cavity 18 comprises a sidewall 50 which may in particular have a cylindrical inner surface in close proximity to an outer surface of the rotor shaft 24. The stator 4 comprises an inlet 14 and an outlet 16. It will be appreciated that inlet may become an outlet and the outlet an inlet respectively depending on the direction of rotation of the rotor. In a variant, the pump may be reversible for bidirectional pumping of liquid through the pump, the direction depending on the direction of rotation of the rotor. Alternatively, the pump may be configured to be unidirectional, allowing rotation of the rotor only in one direction for pumping of fluid only in one direction through the pump.

In the illustrated embodiments, both the inlet and the outlet extend through the sidewall 50 of the stator, however it may be appreciated that the inlet and/or outlet could be formed as a channel of various shapes extending within a body of the stator for coupling at various positions of the stator to a liquid source or a liquid output device, as a function of the application and desired configuration.

A micropump according to embodiments of the invention may advantageously be used in a drug delivery device for administering a liquid drug to a patient. The outlet may therefore be connected to a needle, for transcutaneous administration of a drug, or to a catheter or other liquid conduit connected to the patient. The inlet may be connected to a drug vial, cartridge or other liquid drug source.

The micropump further comprises a seal 26 between the rotor 6 and stator 4, the seal being positioned within the rotor shaft receiving cavity 18 of the stator proximate an insertion end 54 of the stator cavity. In the illustrated embodiment, the cam follower on the stator 24 protrudes from the insertion end 54.

The rotor 6 comprises a cavity 39, and the stator 4 comprises a piston portion 12 that is slidably received within the cavity 39. A sealing ring 44 is positioned around the piston portion between the cavity 39 and piston portion 12. The seal ring 44 is positioned adjacent a free end 56 of the piston portion 12. A piston chamber 42 is thus formed between the free end 56, seal 44 and inner wall 58 delimiting the rotor cavity 39. The piston chamber 42 is fluidly connected to an outer surface 60 of the rotor shaft 24 via a port 38.

In the illustrated embodiments, the port 38 comprises a channel 46 extending from the cavity 39 and an entry portion 40 extending from the rotor shaft outer surface 60. The outer surface 60 may in particular be an essentially cylindrical surface. The entry portion 40 is enlarged with respect to the channel 46 and may for instance have an essentially tapered, funnel, or cup shape with the large opening at the outer surface 60 and a smaller section towards and connected to the channel 46.

Figure 2:
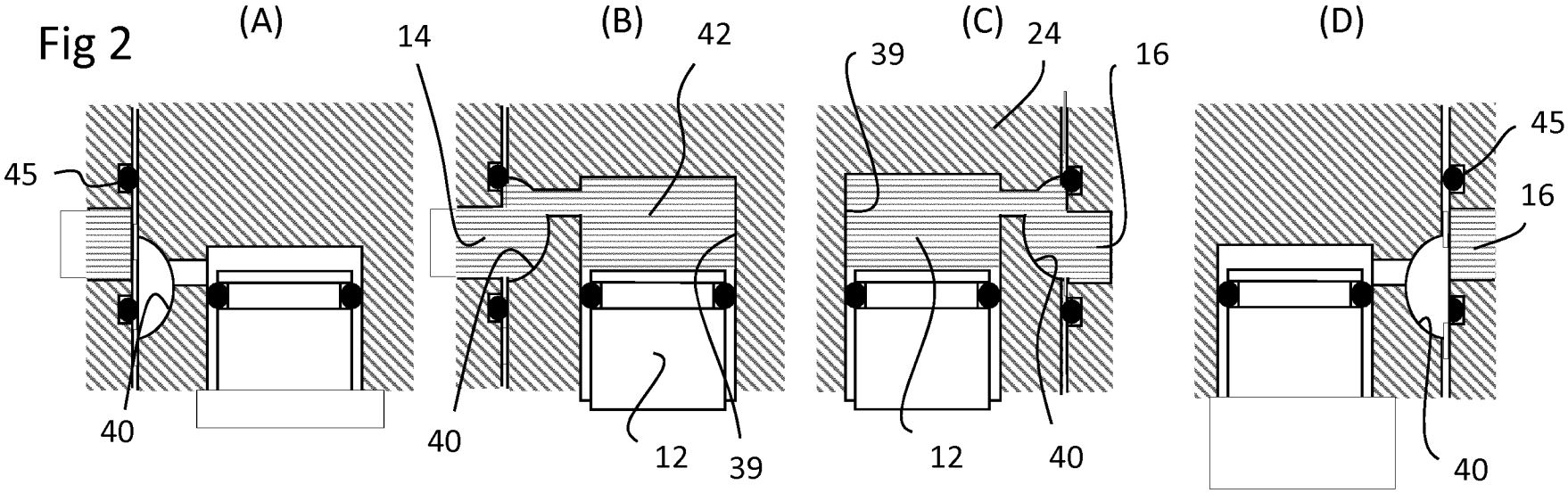
FIGS. 2*a*-2*d* are schematic cross-sectional views illustrating different four rotor positions in a pump cycle of the pump according to the first embodiment, from intake to expulsion of liquid.

In the first embodiment illustrated in FIGS. 1 to 3, during rotation of the rotor relative to the stator, the entry portion 40 of the port 38 moves axially and rotationally relative to the inlet 14 and outlet 16 such that the piston chamber 42 within the rotor 6 may be in liquid communication with the inlet during an intake portion of the pump cycle and subsequently in liquid communication with the outlet 16 during an expel portion of the pump cycle. A seal 45 surrounds the inlet 14 on an inner side of the rotor shaft receiving cavity 18 and a seal 45 surrounds the outlet 16 on an inner side of the rotor shaft receiving cavity 18, the seals biasing against the rotor outer surface 60. A seal (not shown) may also be provided around the entry portion 40. The inlet and outlet seals 45 ensure that the liquid flowing through the inlet and outlet does not leak into the space between the rotor shaft and the receiving cavity 18 in the stator.

During the intake portion of the pump cycle, the entry portion 40 of the rotor overlaps a portion of the inlet 14 over an intake angle α, whereby the axial displacement system imposes an axial movement Ax on the rotor such that the piston chamber 42 increases in volume thus drawing liquid into the piston chamber 42 from the inlet 14. After the rotor passes the intake angle α, the port 38 is closed by the inner surface of the sidewall 50 and does not overlap the inlet 14 nor the outlet 16.

After rotation of the rotor, the expel phase starts when the port 38 overlaps with the outlet 16. The expel phase of the pump cycle occurs over an angular expel range β in which the port 38 remains at least partially overlapping with the outlet 16 and the rotor 6 displaces relative to the stator 4 such that the volume of the piston chamber 42 reduces.

During the intake phase, overlapping of the rotor shaft port 38 with the stator inlet 14 forms an open inlet valve V1, whereas overlapping of the rotor shaft port 38 with the stator outlet 16 forms an open outlet valve V2. Inlet and outlet valves V1, V2 are closed over a certain angular rotation between the intake pump cycle phase and expel pump cycle phase when the rotor shaft port 38 does not overlap the inlet 14 nor the outlet 16.

The stator piston portion 12 inserted in the rotor cavity 39 advantageously allows the piston chamber 42 to be positioned at a level of the inlet and outlet and to be almost completely emptied which reduces the dead volume of liquid between intake and expel operations. It also enables the pumped volume per cycle to be small in comparison to the dimensions of the rotor shaft by simply providing a small diameter rotor cavity 39 and corresponding stator piston.

The piston portion 12 also conveniently improves centering and guiding of the rotor shaft to improve rotational and axial guiding of the rotor shaft, while also reducing frictional forces by the seal 44 between rotor and stator. Also advantageously, the inlet 14 can never be in direct fluid communication with the outlet 16 due to the closed position of the port 38 between the inlet 14 and the outlet 16. The inlet 14 may be provided with an oblong slot shape extending over a rotation angle α' about the axis A that allows overlapping with the rotor port 38 over the intake angle α during which the rotor effects an axial displacement that increases the pump chamber volume 42 during the intake pump cycle phase. The outlet 16 may be provided with an oblong slot shape extending over a rotation angle β' about the axis A that allows overlapping with the rotor port 38 over the expel angle β during which the rotor effects an axial displacement that decreases the pump chamber volume 42 during the expel pump cycle phase. In an advantageous embodiment the rotational angle α of the intake phase and the rotational angle β of the expel phase may advantageously each be in a range of 60 to 120°. This allows on the one hand a sufficient angular range to effect a smooth axial displacement of the rotor to fill, respectively to empty, the pump chamber while ensuring a valves closed safety margin between the inlet and outlet.

It may be noted that within the scope of the invention, the intake angle α may be different from the expel angle β.

Figure 3C:
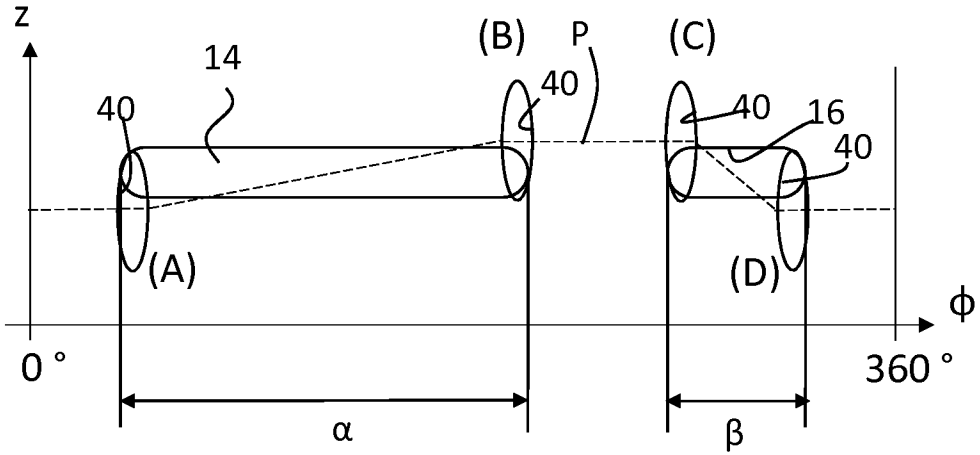
FIGS. 3*a*-3*c* are views illustrating a developed displacement profile of a rotor valve port relative to a stator inlet and outlet over a 360° rotation cycle, according to three variants of first embodiment.
Figure 3A:
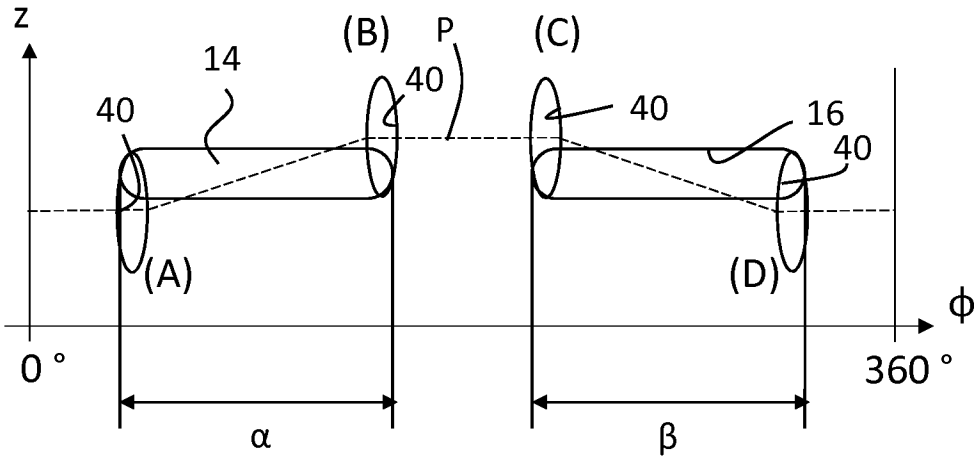
Figure 3B:
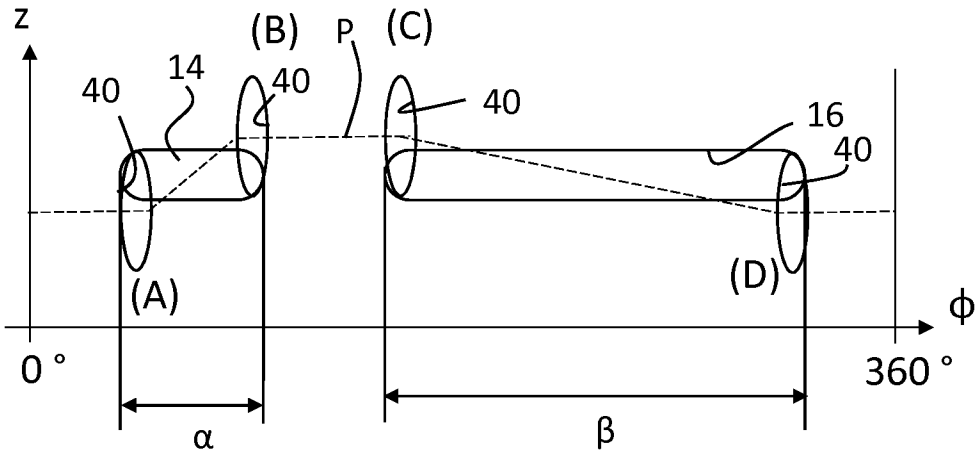
Figure 4:
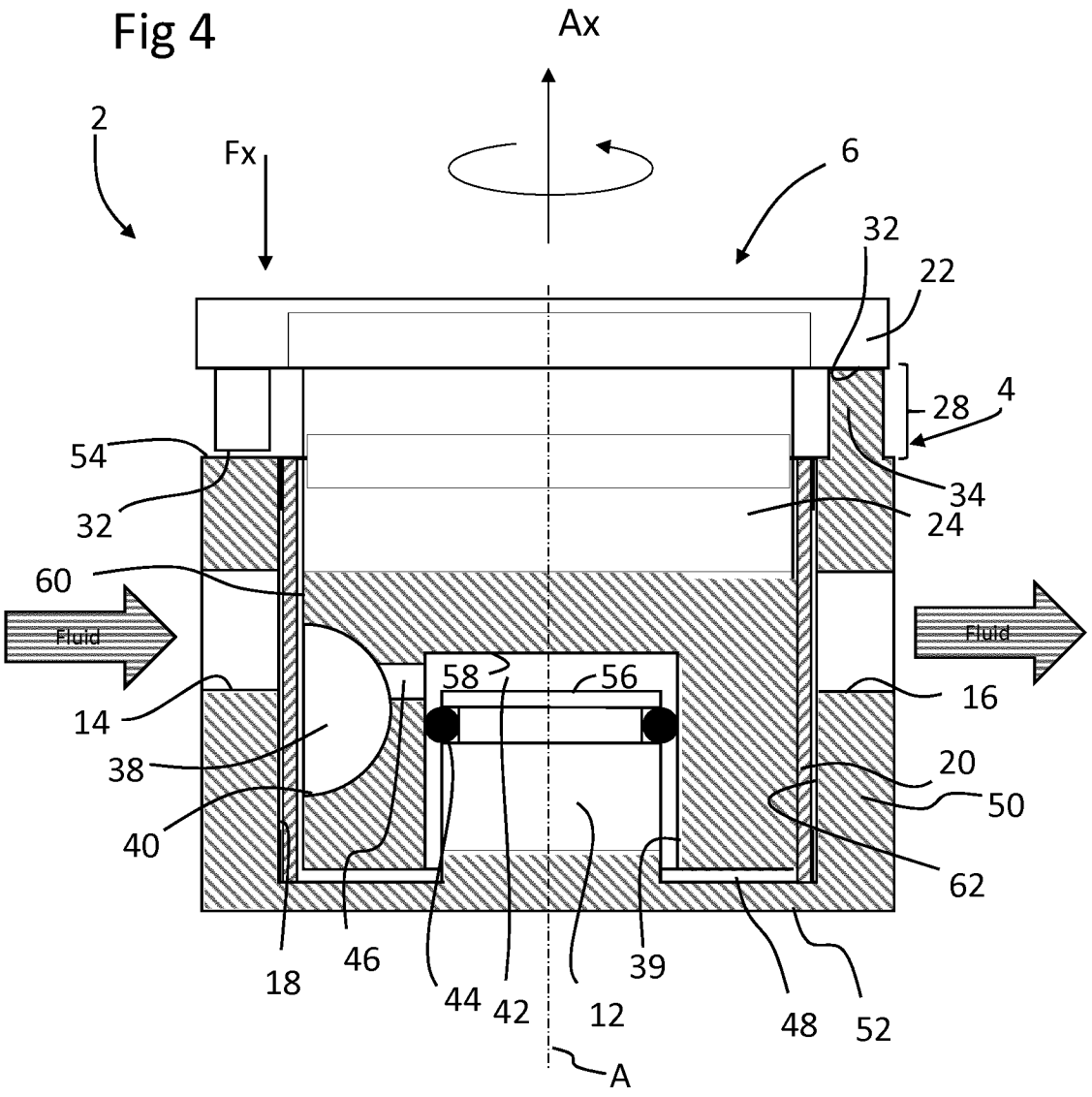
FIG. 4 is a schematic cross-sectional view of a pump module of a micropump according to a second embodiment of the invention.

In an advantageous embodiment, the intake angle α is greater than the expel angle β, for instance as illustrated in FIG. 3*b*. In the aforementioned embodiment, the intake phase of the pump cycle is slower than the expel phase to reduce the negative pressure on the liquid to avoid any associated adverse effects such as bubble creation. The expel phase may be shorter since in many applications liquids may support high expel flow rates and pressures. Nevertheless, in another variant it is also possible to inverse the relationship in order to have a shorter intake phase than the expel phase, for instance as illustrated in FIG. 3*c*. A slower expel phase may for instance be desired in certain applications to reduce the impulse delivery of liquid during the expel phase.

In the embodiment illustrated in FIG. 3*a*, the intake and expel phases are substantially identical, however as mentioned above the angular range of the inlets and outlets may be varied in conjunction with the axial displacement system depending on the desired intake and outtake pressures and flow rates.

The axial displacement profile P as a function of the angular displacement ϕ may also be varied to control and optimize the intake and expel flow rates of the liquid.

In the second embodiment illustrated in FIGS. 4, 5*a*-5*d* and 6, the piston chamber 42 is not in direct fluid communication with the inlet 14 or outlet 16. A membrane 20 fixed to the inner surface of the stator sidewall 50 is mounted between the outer surface 60 of the rotor and the inner surface 62 of the stator cavity 18. The membrane 20 is elastic and configured to be sucked into the entry portion 40 when there is an under-pressure in the piston chamber 42, which is in fluid communication with the entry portion 40. During the intake phase, the increased volume of the piston chamber 42 creates an under-pressure in the piston chamber which sucks in a portion of the membrane 20 into the entry portion 40. Since during the intake pump cycle phase the entry portion 40 overlaps at least partially the inlet 14, liquid from the inlet is drawn into the volume of the entry portion 40 formed by the sucked in portion of membrane. As the rotor turns, the liquid in the entry portion is rotated with the entry portion, whereby the membrane, which does not rotate, gets sucked slidingly into the entry portion as the rotor rotates. The liquid within the entry portion is captured in the volume thereof and moved with the rotor. When the entry portion 40 no longer overlaps the inlet 14, liquid in the entry portion is captured between the membrane and the inner surface 62 of the stator sidewall 50 and moved therealong until the entry portion 40 overlaps the outlet 16. Under-pressure in the piston chamber 42 is reduced and the membrane within the entry portion moves back to a position against the stator cavity sidewall thus expelling the liquid that was captured in the entry portion through the outlet 16. The membrane may in particular be made of a thin elastic polymer sheet configured to easily slide and deform in and out of the entry portion as the rotor is rotated.

In a variant, an elastic membrane may be fixed to the rotor covering the entry portion 40 of the rotor shaft port 38. The membrane in this variant thus rotates with the rotor. In this variant, a seal surrounding the entry portion 40 and biased against the inner surface 62 of the stator sidewall is provided to ensure that liquid captured within the entry portion between the inlet and outlet is hermetically sealed and remains within the entry portion between the intake phase and expel phase of the pump cycle.

List of Features Illustrated

Micropump 2
Stator 4
Inlet 14

Outlet 16
Rotor shaft receiving cavity 18
  Side wall 50
    Insertion end 54
  Base wall 52
Piston portion 12
  Free end 56
  Seal 44
Membrane 20
Rotor 6
Head 22
Shaft 24
  Rotor shaft port 38
    Entry portion 40
    Channel 46
    Seal 45
  Rotor cavity 39
    Piston chamber 42
    Inner wall 58
  End 48
  Outer (cylindrical) surface 60
Rotor-Stator Seal 26
First valve V1
Second valve V2
Axial Displacement System
Camming system 28
  Cam track on rotor 32
  Complementary cam follower on stator 34
Coupling 30
  Biasing Mechanism 36
Rotary Drive 8

The invention claimed is:

1. A micropump comprising a stator and a rotor axially and rotatably movable relative to the stator, the stator comprising a rotor shaft receiving cavity, an inlet and an outlet fluidly connected to the rotor shaft receiving cavity, the rotor comprising a shaft received in the rotor shaft receiving cavity, wherein the rotor shaft comprises a rotor cavity receiving a piston portion of the stator therein to form a piston chamber, a seal mounted between the piston portion and inner sidewall of the rotor cavity to sealingly close an end of the piston chamber, the rotor further comprising a rotor shaft port fluidly connecting the piston chamber to an outer surface of the rotor shaft, the rotor shaft port arranged to overlap at least partially the inlet over a rotational angle ($\alpha$) of the rotor corresponding to a pump intake phase, and arranged to overlap at least partially the outlet over a rotational angle ($\beta$) of the rotor corresponding to a pump expel phase.

2. The micropump according to claim 1 wherein the rotor shaft port comprises an entry portion having a convex or tapered shape with a large diameter at the rotor outer surface and a small diameter towards rotor cavity.

3. The micropump according to claim 1 wherein the inlet has an oblong shape that extends over an angular segment of at least 30°.

4. The micropump according to claim 1 wherein the outlet has an oblong shape that extends over an angular segment of at least 30°.

5. The micropump according to claim 1 wherein the inlet extends over an angle about the axis of rotation A along an inner surface of the rotor shaft receiving cavity between 30° and 120°.

6. The micropump according to claim 1 wherein the outlet extends over an angle about the axis of rotation A along an inner surface of the rotor shaft receiving cavity between 30° and 120°.

7. The micropump according to claim 1 wherein the piston portion extends from a basewall of the stator, an end of the rotor shaft positioned adjacent the basewall.

8. The micropump according to claim 1 wherein the stator and rotor comprise a camming system defining an axial displacement of the rotor relative to the stator as a function of the angular displacement of the rotor relative to the stator.

9. The micropump according to claim 1 comprising a rotary drive coupled in rotation to the rotor via a coupling, the coupling comprising a biasing mechanism applying a force on the rotor towards the stator.

10. The micropump according to claim 1 wherein the camming system comprises a cam track on one of the rotor and the stator, and a cam follower on one of the stator and the rotor, the cam track and cam follower being positioned on an outer diameter of a head of the rotor, the head being connected to an end of the rotor shaft.

11. The micropump according to claim 1, further comprising an elastic membrane positioned between the rotor and the stator and arranged to cover an entry portion of the rotor shaft port on the rotor shaft, the membrane being deformable into the entry portion due to a pressure on an inlet side being greater than a pressure in the piston chamber.

12. The micropump according to claim 11 wherein the membrane is fixed non-rotatably to the stator.

13. The micropump according to claim 11 wherein the membrane is fixed to the rotor and covers the entry portion of the rotor shaft port.

* * * * *